United States Patent [19]

Asfar

[11] 3,999,526

[45] Dec. 28, 1976

[54] VAPORIZING CARBURETOR

[76] Inventor: Khaled R. Asfar, H-13 Sturbridge Square, Blacksburg, Va. 24060

[22] Filed: Nov. 18, 1975

[21] Appl. No.: 633,152

[52] U.S. Cl. ..... 123/134; 261/122; 123/133

[51] Int. Cl.[2] ..... F02M 17/22

[58] Field of Search ..... 123/124 R, 119 DB, 134, 123/133; 261/16, 122

[56] References Cited

UNITED STATES PATENTS

| | | | |
|---|---|---|---|
| 474,838 | 5/1892 | Lambert | 123/134 |
| 610,159 | 8/1898 | Speer | 123/134 |
| 1,121,137 | 12/1914 | Schoonmaker | 123/134 |
| 1,195,315 | 8/1916 | Williams | 123/134 |
| 2,114,655 | 4/1938 | Leibing | 123/179 DB |
| 3,713,429 | 1/1973 | Dwyre | 123/134 |

*Primary Examiner*—Ronald H. Lazarus
*Attorney, Agent, or Firm*—Mason, Fenwick & Lawrence

[57] ABSTRACT

A vaporizing carburetor which introduces gasoline vapors into atmospheric air without any heating by directing a stream of air through liquid fuel to cause vaporization and a depression, as a consequence of evaporation, in the temperatures of both the fuel and the resulting mixture, to produce a chemically correct fuel to air ratio and a homogeneous distribution of fuel vapors in the airstream.

9 Claims, 4 Drawing Figures

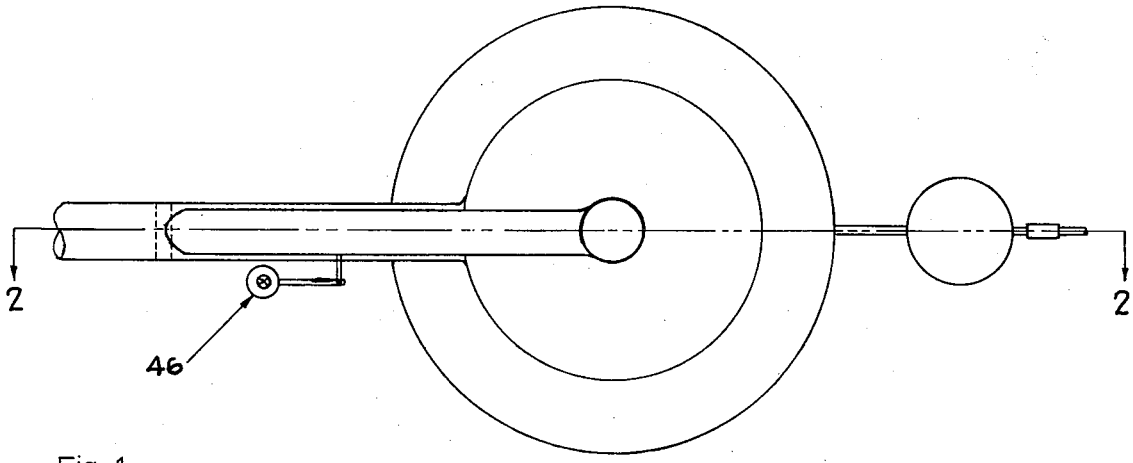
Fig. 1,
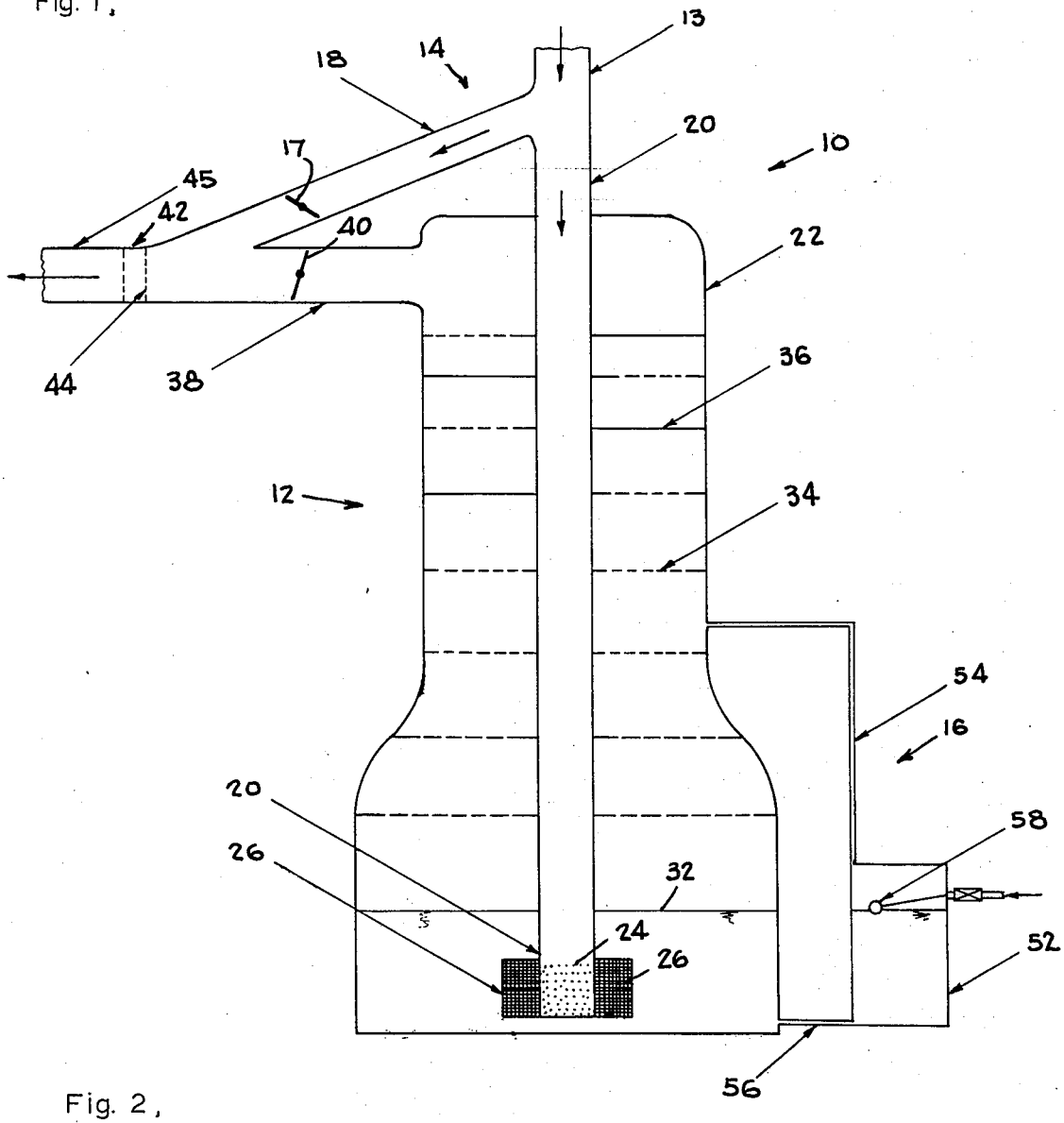
Fig. 2,

VAPORIZING CARBURETOR

SUMMARY OF THE INVENTION

This new system for the carburetion of spark ignition internal combustion engines yields completely and perfectly distributed vaporized fuel in the airstream entering the engine. It is the optimum process for carburetion to produce the best fuel economy at any speed, but particularly at low speeds where conventional systems produce high fuel consumption. Moreover, our system provides a homogeneous fuel/air mixture to each cylinder in a multi-cylinder engine, reduces the crankcase combustibles, eliminates flooding of the engine, improves startability, and reduces exhaust pollutants.

In the present invention, the vacuum created by the engine intake causes an air stream to pass through a chamber containing gasoline fuel, where the air causes evaporation of the fuel. The air/fuel mixture then passes through several mixing baffles to obtain uniformity of the mixture. Adjustment of the fuel-to-air ratio to the chemically correct ratio is accomplished by throttling valves in two tubes, one supplying fresh air and the other supplying the fuel/air mixture from the mixing baffles. Due to the turbulence that may occur in the evaporation chamber, it is difficult to control the fuel level directly, hence, a fuel-level-control system is introduced to maintain a constant level fuel in the chamber. This control system includes a small tank which supplies the chamber with fuel when the level of fuel in the chamber drops below the level in the tank and the level of fuel in the tank is controlled by a valve and a float. The pressures on the fuel in the vessel and the tank are equalized by communicating the space above the fuel in the tank with the space above the fuel in the chamber by a small pipe.

Other objects and advantages of the invention will become more apparent to those persons having ordinary skill in the art to which the invention pertains, from the following description taken in conjunction with the accompanying drawings wherein:

FIG. 1 is a fragmentary elevational view of the present invention showing the position of the throttling mechanism;

FIG. 2 is a front sectional view taken along 2—2 in FIG. 1 and showing the interior of the system with the evaporating element and the fuel-level-control system;

DETAILED DESCRIPTION

As shown in the various figures, a preferred embodiment of the invention generally indicated at 10 includes evaporating and mixing elements 12, throttling and mixing passageways 14, and a fuel-level-control system 16.

Figure 4:
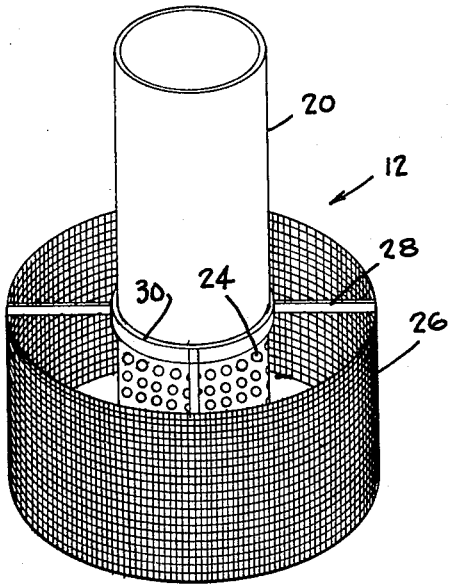
FIG. 4 is a perspective view of an evaporating element of the present invention.

A flow of air is induced by the engine suction and enters the system through intake passageway 13 after flowing through an air filter or the like. Depending on the setting of an air bypass valve 17, the flow of air may then be divided with a small portion of the air passing through a bypass tube 18 and the remainder passes through an intake tube 20, which extends from the top of an evaporation chamber 22 to the bottom of the chamber. The lower end of the air intake tube 20 is closed and the wall of the tube adjacent the lower end is perforated with a large number of small holes 24 as best shown in FIG. 4. The total area of these holes is equal to the cross-section area of the intake tube 20. A cylindrical sieve 26 is formed of copper wire screen and has a diameter twice that of the intake tube 20. The sieve 26 surrounds a lower part of the intake tube 20 and is supported in a concentric position by support arms 28 fixed at their outer ends to the sieve 26 and fixed at their inner end to a support ring 30 which frictionally fits over the intake tube 20. The sieve 26 and the holes 24 are positioned below the surface 32 of the fuel as shown in FIG. 2. Sieve 26 and holes 24 are immersed in the liquid fuel contained in vessel 22.

The air flows through the holes 24 of the intake tube 20 with a high velocity and bubbles through the liquid fuel to vaporize some of the fuel. The sieve 26 causes the air streams from the holes 24 to separate into smaller bubbles so that each bubble will become saturated with vaporized fuel. The fuel/air mixture leaving the surface 32 of the fuel in the chamber 22 passes through a multi-layer mixing system which includes perforated plates spaced logarithmically along the intake tube 20. The lower plates 34 are perforated with small holes over the entire area while the upper plates 36 are perforated over half of their area as indicated in FIG. 2. Adjacent upper plates are rotated 180 degrees with respect to adjacent plates as indicated in FIG. 2 thereby providing a tortuous path for the fuel/air mixture as it flows out of the evaporation chamber. An outlet tube 38 at the top of the chamber has a throttle valve 40 pivotally mounted therein to control the flow of fuel/air mixture from the chamber. The air flows through the bypass tube 18 and combines with the fuel/air mixture from the outlet tube 38 in mixing region 42 which consists of a three perforated plates 44 similar to upper plates 36. Finally, the mixture of air and vaporized fuel flows through to an engine manifold inlet tube 45 where it is drawn into the engine manifold. A throttling mechanism 46 is shown in detail in FIG. 3. The purpose of this mechanism is to permit the engine speed to increase while the fuel-to-air ratio is kept constant at any running speed. It is well-known that vaporized fuel/air ratios greater than 0.11 will prevent combustion in the cylinders. Hence, if the system was used with the air bypass throttle valve 17 closed, the engine will not start. Therefore, the opening of the air valve 17 at the idling speed is selected to produce the chemically correct ratio of fuel-to-air. Actual running tests showed that the system idling speed went down to about ⅔ of those of conventional systems; the operation was steady, smooth and vibrationless; and reduction in the pollutants occurred in the exhaust area.

Figure 3:
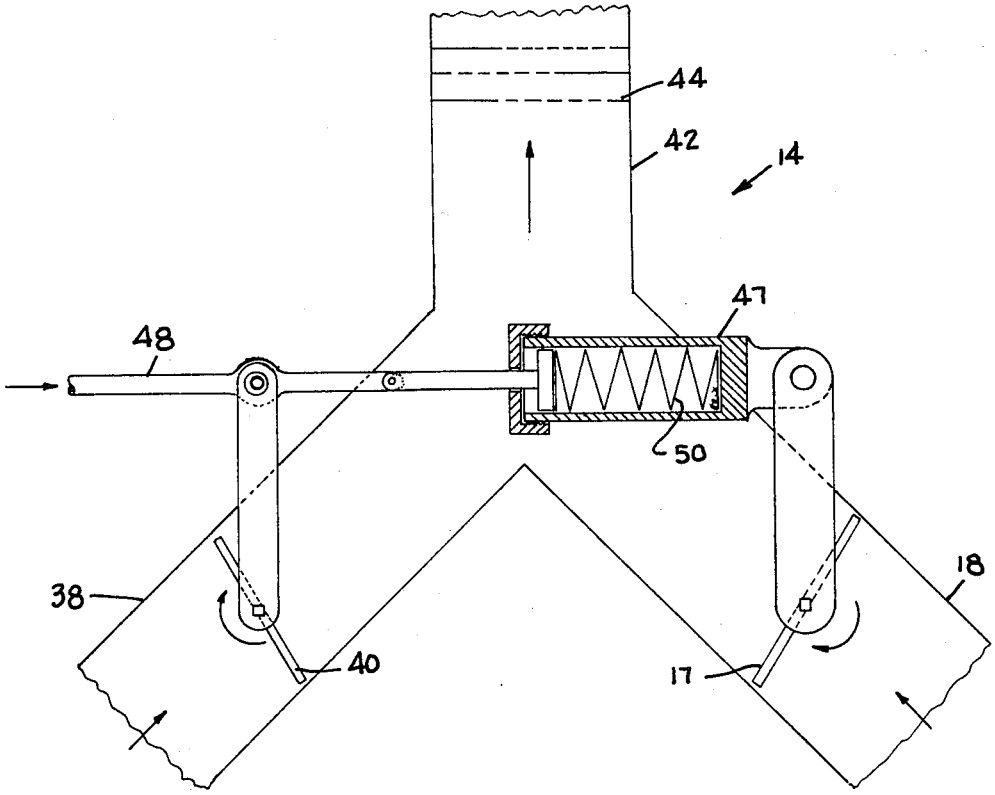
FIG. 3 is an enlarged detailed drawing of the throttling mechanism of the present invention.

The fact that vaporization decreases at high air velocities when the liquid level remains constant necessitates either (i) increasing the fuel level in the chamber 22 or (ii) introducing the perforated plates 34, which will carry thin layers of fuel and thus promote evaporation. In the second case, the bypass air valve 17 in tube 18 should be closed completely while the throttle valve 40 in outlet tube 38 should continue to open as speed increases which is accomplished with a compression spring element 47 which couples the two valves as shown in FIG. 3. Initially, the air bypass valve 17 is open for idling conditions while the throttle valve 40 is partially open. When the speed increases, the throttling mechanism causes the throttle valve 40 to open more and causes the bypass valve 17 to close gradually. When the valve 17 is completely closed, the accelerator acting through an accelerator link 48 begins to act against a spring 50, thus opeing the throttle valve 40 gradually with bypass valve 17 fully closed.

The fuel-level-control system includes a small tank 52 connected to the chamber 22 by a vent pipe 54 and fuel pipe 56. The fuel pipe 56 supplies the chamber with fuel. The vent pipe 54 equalizes the pressure over the fuel in the tank 52 and the chamber 22 so that the level of the fuel will not be affected by any turbulence which may occur in the liquid fuel in the chamber. The fuel supply to the tank 52 is controlled by a float 58 and associated valve which determines the fuel level.

It is to be understood that numerous modifications of the disclosed embodiments of the subject invention will undoubtedly occur to those of skill in the art an the spirit and scope of the invention is limited solely in light of the appended claims.

I claim:

1. A spark ignition internal combustion engine including a vaporization carburetor system for supplying a fuel/air mixture to the intake manifold, said vaporization carburetor system comprising an intake passageway through which atmospheric air may be drawn by the intake manifold vacuum of the engine, an air bypass tube having a first end communicating with the intake passageway, an air bypass valve positioned in the bypass tube for controlling the flow of air through the bypass tube, an intake tube having one end communicating with the intake passageway, a closed evaporation chamber for containing a supply of liquid fuel through which air may be bubbled to evaporate the fuel, means for maintaining a constant level of fuel in the evaporation chamber, said intake tube extending into the evaporation chamber with a portion of the intake tube extending below the fuel level and having at least one opening below the fuel level thereby permitting air to flow through the fuel to evaporate the fuel and form a fuel/air mixture, an outlet tube havng a first end communicating with the evaporation chamber to permit removal of the fuel/air mixture from the chamber, a throttle valve positioned in the outlet tube for controlling the rate of flow of fuel/air mixture from the evaporation chamber, a manifold inlet tube having one end communicating with the intake manifold of the engine and the other end communicating with the second end of the air bypass tube and the second end of the outlet tube, means for maintaining the air bypass valve in a closed position until the throttle valve has closed to a predetermined position and for opening the air bypass valve as the throttle valve is closed past said predetermined position.

2. The system of claim 1 wherein the means for maintaining a constant level of fuel in the evaporation chambr includes a tank having a fuel inlet, a float valve to maintain a constant level of fuel in the tank, a fuel outlet passageway connected to the evaporator chamber below the desired fuel level of the chamber, a vent pipe communicating the top of the tank with the top of the chamber to equalize the pressure between the tank and the chamber, said tank is positioned such that the level of fuel in the tank is level with the desired level of fuel in the chamber.

3. The system of claim 1 wherein the opening in the intake tube which is below the fuel level in the chamber includes a plurality of holes circumferentially spaced apart around the intake tube with the total area of the holes equal to the cross-sectional area of the intake tube.

4. The system of claim 3 additionally including a cylindrical sieve mounted in the chamber concentric with the intake tube and extending below the level of fuel.

5. The system of claim 1 additionally including baffle plates between the fuel level in the evaporation chamber and the outlet tube, said baffle plates having a plurality of openings therethrough.

6. The system of claim 5 wherein at least two of the baffle plates have openings on one side of the intake tube and these baffle plates are oriented with alternate plates having the openings on opposite sides of the intake tube.

7. The system of claim 6 wherein the manifold inlet tube has a perforated plate mounted therein to ensure a homogeneous mixing of the air flowing through the bypass with the fuel/air mixture flowing through the outlet tube.

8. The system of claim 4 wherein the sieve is formed of copper screen.

9. The system of claim 4 wherein the sieve has a diameter which is twice the diameter of the intake tube.

* * * * *